US008105134B2

(12) United States Patent
Palushaj

(10) Patent No.: US 8,105,134 B2
(45) Date of Patent: Jan. 31, 2012

(54) LOW PRESSURE POLISHING METHOD AND APPARATUS

(75) Inventor: Simon Palushaj, Washington, MI (US)

(73) Assignee: Epoxi Tech, Inc., Madison Heights, MI (US)

( * ) Notice: Subject to any disclaimer, the term of this patent is extended or adjusted under 35 U.S.C. 154(b) by 7 days.

(21) Appl. No.: 12/427,413

(22) Filed: Apr. 21, 2009

(65) Prior Publication Data

US 2009/0221212 A1 Sep. 3, 2009

Related U.S. Application Data

(63) Continuation-in-part of application No. 11/660,623, filed on Feb. 16, 2007, now Pat. No. 7,988,539, and a continuation-in-part of application No. 11/042,698, filed on Jan. 25, 2005, now Pat. No. 7,081,047.

(60) Provisional application No. 61/095,077, filed on Sep. 8, 2008.

(51) Int. Cl.
*B24D 15/00* (2006.01)

(52) U.S. Cl. ..... 451/490; 451/353; 451/359

(58) Field of Classification Search ..... 451/490, 451/540–543, 548, 350, 353, 359, 508, 259; 15/28, 180
See application file for complete search history.

(56) References Cited

U.S. PATENT DOCUMENTS

| | | | | |
|---|---|---|---|---|
| 2,480,739 | A * | 8/1949 | Johnson | 15/28 |
| 4,236,269 | A * | 12/1980 | Block | 15/180 |
| 5,438,728 | A * | 8/1995 | Kubes et al. | 15/180 |
| 6,126,533 | A | 10/2000 | Johnson et al. | |
| 6,506,100 | B2 * | 1/2003 | Blattler | 451/44 |
| 2006/0014482 | A1 * | 1/2006 | Wentworth et al. | 451/466 |

FOREIGN PATENT DOCUMENTS

| | | | |
|---|---|---|---|
| WO | WO-2005/113198 | A2 | 12/2005 |
| WO | WO-2008/088908 | A1 | 7/2008 |

OTHER PUBLICATIONS

PCT International Search Report dated Dec. 22, 2009 for PCT/US2009/056056.

* cited by examiner

*Primary Examiner* — Dung Van Nguyen
(74) *Attorney, Agent, or Firm* — Rader, Fishman & Grauer, PLLC

(57) ABSTRACT

An improved low pressure low speed concrete polishing apparatus and method of cleaning and polishing a floor is used with a conventional rotary flooring machine. A polishing pad has interchangeable polymer strips that are slideably received within the housing of the pad. The polymer strips have an abrasive material embedded therein which collectively work to polish the floor while cleaning the floor during normal low speed floor cleaning conditions.

17 Claims, 11 Drawing Sheets

LOW PRESSURE POLISHING METHOD AND APPARATUS

CROSS REFERENCE TO RELATED APPLICATIONS

This application claims priority to U.S. Provisional Patent Application No. 61/095,077, filed on Sep. 8, 2008, entitled LOW PRESSURE POLISHING METHOD AND APPARATUS; and is a continuation-in-part of related application U.S. application Ser. No. 11/660,623 filed Feb. 16, 2007 now U.S. Pat. No. 7,988,539, entitled ABRASIVE CLEANING DEVICE; and related continuation-in-part Issued Pat. No. 7,081,047 (application Ser. No. 11/042,698 filed Jan. 25, 2005) entitled BRISTLE BRUSH FOR CONCRETE SANDING, the disclosures of which are incorporated by reference in their entirety.

TECHNICAL FIELD

This invention relates to a method of polishing surfaces and an apparatus for polishing or modifying floor surfaces.

BACKGROUND AND SUMMARY OF INVENTION

Concrete is traditionally used for floors in both residential and commercial applications in view of its robustness and economic benefits. Depending upon the circumstances, the concrete may be left unfinished, partially finished or completely finished wherein a high gloss decorative service is obtained.

In warehouses, factories, etc., concrete floors are routinely cleaned by rotary driven machines that employ brushes located on the underside of the machinery whereby the machinery traverses the floor to provide a clean surface. Typically these floor cleaning machines have a tendency of progressively deteriorating the surface of the concrete floor. This is caused by the bristles extending into the naturally occurring crevices in the concrete floor thus causing minute particles of the concrete to break away. Through the repeated cleaning utilizing this floor polishing machine is then typically employed to treat the surface of the floor so as to restore the floor back to a desirable appearance.

Typically the flooring machines that are used on a routine basis sit idle as they have a limited purpose, which is to clean the floor. These traditional flooring machines are not used to polish the floor, but merely for the single purpose of cleaning the floor. Likewise, a separate floor polishing machine traditionally is used for the sole purpose of polishing the concrete floor when the floor condition has sufficiently deteriorated. Accordingly, because these machines have limited purposes, they are seldom used, thus creating inefficiencies for a business.

It will be desirable to forego the aforementioned costly steps by providing an improved cleaning and honing brush that works as an attachment to an ordinary cleaning machine, such as a Tennant or Advance brand scrubber machine. It would be desirable to provide an improved cleaning and honing brush that operates under low pressure, does not require an independent power source, continuously exposes new abrasive material during the cleaning process and has interchangeable replaceable polymer brush strips that can be easily removed and replaced with replacement polymer brush strips.

The aforementioned problems may be overcome by providing a polymer brush strip that may be co-extruded with diamond particles integral with the head of the brush strip.

It will further be desirable to provide a floor resurfacing device that operates under low speed and low pressure conditions while utilizing a diamond impregnated brush made of polymer matrix that can be used on ordinary rotary machines including low power, low pressure automatic flooring machines.

It will be desirable to provide an improved polishing system that can be used in connection with a traditional automatic flooring machine wherein a series of diamond embedded polymer strips are used with a rotary disc. The rotary disc bearing the polymer strips can also be used for cleaning the surface of the concrete as well as providing a polishing aspect during the process of cleaning. The floor cleaning process employs a rotary disc having polymer strips with greater grit density so as to provide an improved surface finish. The process is repeated routinely whereby at each cycle the polymer strips are changed out to have finer grit size so as to continuously enhance the surface finish quality. The aforementioned process is accomplished while cleaning the floor during low speed and low pressure conditions. Said process can be used with floors other than concrete floors.

The present invention also solves a problem that is found in the maintenance of floors in offices. For example, in office settings a common floor covering is vinyl composite tile (VCT). Wax is often applied over the tile so as to protect its surface and to provide an enhanced floor appearance. Over time these floors acquire a build up of wax and other particles that need to be removed so as to reestablish the floor's appearance to a new-like condition. Traditionally, a common way of stripping wax and other particles from floors was to use chemicals. The chemicals loosen the wax so it can then be removed via a scrubbing process. Typical ways of removing the loosened wax were to use an abrasive pad. However, the loosened wax tends to gum up the surface of the pad making removal very difficult. It would be preferred to provide a more environmentally green method of stripping wax from VCT, for example, use of water would be preferred. In order to accomplish complete removal of wax from VCT, an improved pad driver with brush design would be desirable. It would also be desirable to provide an improved brush that has a polymer component with a metal component.

BRIEF DESCRIPTION OF THE DRAWINGS

Reference is now made to the attached drawings in which.

DETAILED DESCRIPTION OF THE PREFERRED EMBODIMENTS

Figure 1:
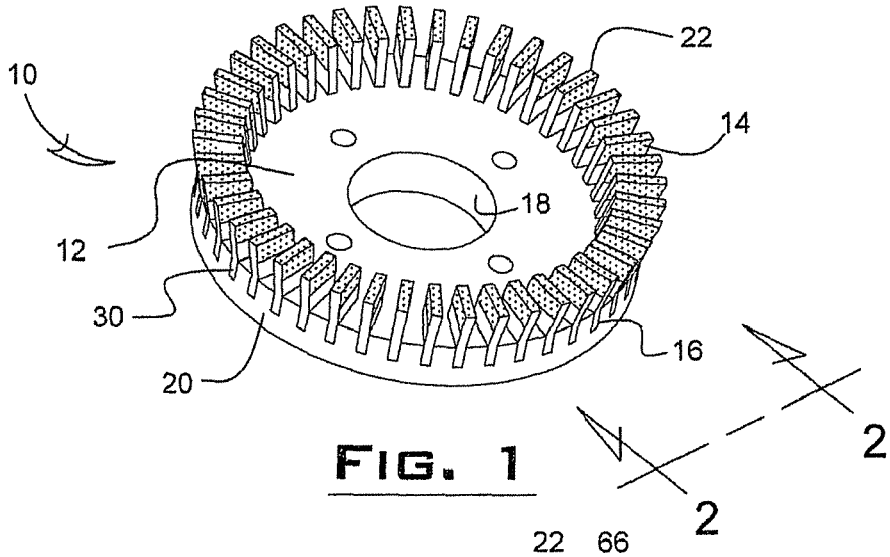
FIG. 1 is a perspective view of a low speed cleaning and polishing device having a plurality of polymer brush strips located on a housing.

An improved polishing device 10 includes a circular-shaped pad 12 having a plurality of polymer strips 14 retained within slots 16 of the pad 12. The pad 12 has an internal diameter 18 that is operable to receive the drive shaft of a rotary machine, including an automatic flooring machine (not shown). The flooring machine can be of the type that traditionally cleans concrete floors as is well known in the art. The drive shaft may impart motion to the pad 12 at approximately 125 to 200 rpm's while applying approximately 150 to 200 lbs. of total pad pressure. The device 10 can be used in low speed low pressure conditions. However, it is possible to utilize the various devices disclosed herein in higher speed applications where higher pressures are encountered. For example, if desired, the present invention could be used with machines operating in the 125-1500 RPM range and at head pressures in the 50-800 PSI range.

It will be appreciated that several polishing devices 10 can be utilized in concert with a standard flooring machine when floors are being cleaned resulting in both a cleaned and polished floor. By employing a system of changing out the polymer strips 14, or changing the device 10 and thus modifying the abrasiveness of the device 10, an improved method of cleaning and polishing a concrete floor is provided. The pad 12 may be approximately 6 to 20 inches in diameter and is preferably made of plastic or some other substance that is resistant to corrosion yet sufficiently rigid to withstand operating conditions.

Figure 2:
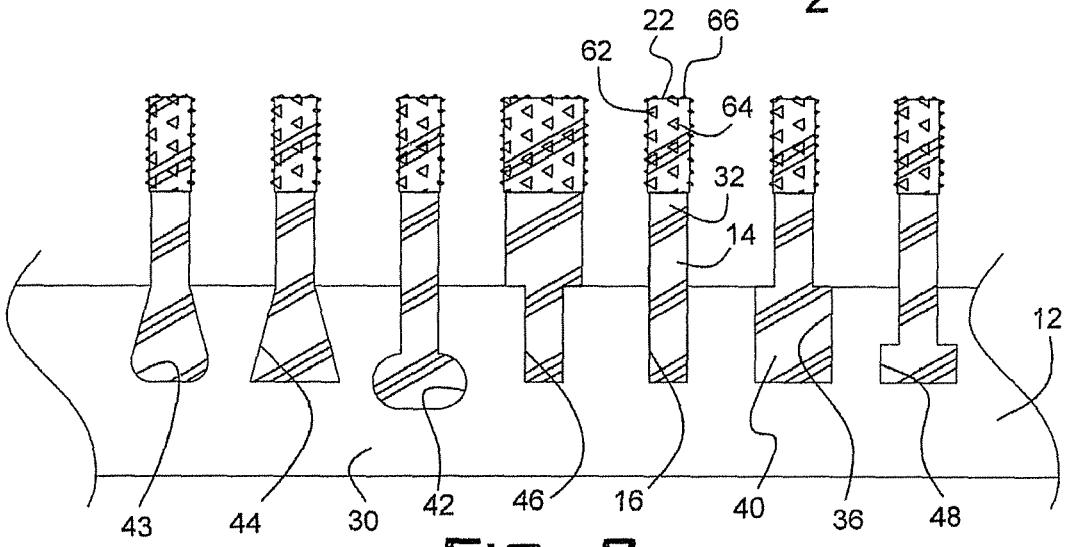
FIG. 2 is a side elevational view of the polishing device taken from the perspective of arrows 2-2 of FIG. 1, showing alternative configurations of the geometry of the brush strips.
Figure 3:
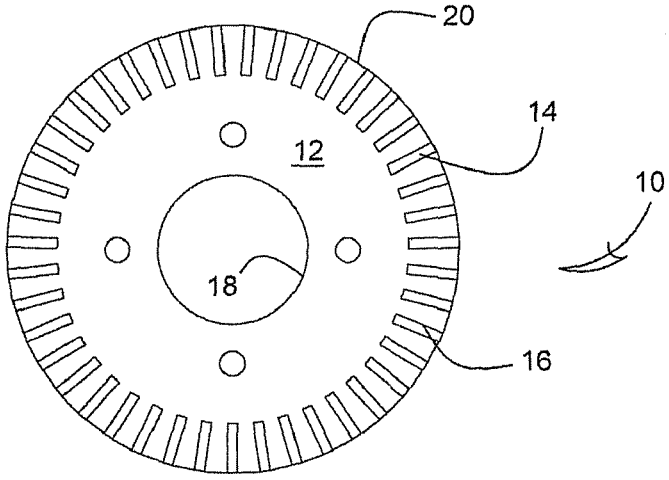
FIG. 3 is a top view of the FIG. 1 device.

With reference to FIGS. 1-3, the pad 12 has a plurality of slots 16 that extend radially from the outside diameter 20 of the pad 12 towards the internal diameter 18. It has been found that with pad pressure of 150 to 200 pounds and RPMs 125-200 the preferred number of slots 16 in the pad may be forty three. The slots may be equally spaced apart and have a depth at a third of the height of the polymer strips 14. Each slot has a width of slightly smaller than the width of the strips 14. Although the slots may be slightly wider than the width of the strips 14 to facility assembly. It will be appreciated that more or less slots 16 can be equally spaced around the circumference of the pad 12. However, it is important to include a sufficient number of polymer strips 14 positioned within slots 16 around the pad 12 so as to maintain appropriate surface pressure between the tip 22 of the polymer strip 14 and the surface 24 of the concrete that is being finished. Accordingly, the number of polymer strips 14 that are to be used with a given pad 12 is an important combination and impacts the performance of the present invention. Further, the flexible and thin wall configuration of the strips 14 allow the stock being removed to flow out from the area of contact. This arrangement does not diminish the cut at the point of contact between the abrasive material and the substrate being sanded/worked.

Figure 4:
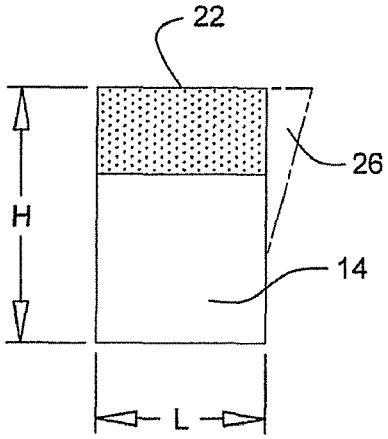
FIG. 4 is a side view of one of the polymer strips shown removed from the housing of the FIG. 1 device.
Figure 5A:
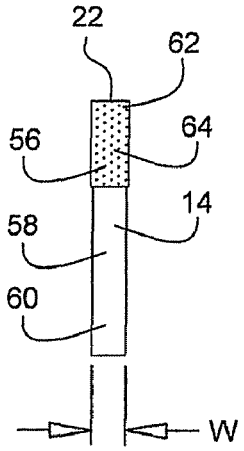
FIG. 5A is an end view of the polymer strip shown in FIG. 4.

As shown in FIGS. 4 and 5A, the polymer strip 14 may have a length L of approximately 1 to 2 inches and height H of approximately one to two inches. The width W of the polymer strip 14 may be approximately 1/16 to 1/8 of an inch. This preferred configuration may be used in conjunction with a pad 12 having a diameter of about 16 inches. The size of the strip 14 may be modified in view of the diameter pad 12 that is employed.

The length L of the polymer strip 14 is wider than the pores in the concrete to which the device 10 is finishing. Thus, depending upon the texture or finish of the concrete being finished, the polymer strips having a variety of lengths L may be utilized. Generally, however, it is preferred that the device 10 employ polymer strips 14 having consistent lengths L which is generally shown in FIG. 1. A device 10 could employ polymer strips 14 utilizing a variety of lengths L disposed at various slot 16 positions about the pad 12 as long as they are radially positioned (not shown). It will also be appreciated that the strips 14 with common lengths L can be offset in the radial direction (not shown) so as to cover a greater surface area of the pad 16. It is possible to use strips 14 having a size that is smaller than the size of the slot 16. Various locking arrangements could be employed to secure the strips 14 to the pad 12.

The geometric configuration of each polymer strip 14 can be modified. By changing the geometry of the strip, the performance and connectability of each strip 14 can be modified. As shown by the phantom line in FIG. 4, the geometry of the polymer strip 14 can be modified to have a leading edge portion 26, thus, providing a portion that extends past the outer diameter 20 of the pad. This may improve usability of the device 10 when trying to reach into corners or other tight places. The strips 14 shown in the FIG. 1 device do not depict this leading edge 26 feature.

With reference to FIGS. 1 and 2, each slot 16 is provided within the outer radial edge 30 of the pad 12 and extends internally a predetermined distance that is at least commensurate with the length L of the polymer strip 14. The slot 16 has a geometric configuration slightly smaller than the outer profile 32 of the polymer strip 14. A compression fit is thereby created between the outer profile 32 of the polymer strip 14 and the slot 16 sufficient to retain the polymer strip 14 relative to the pad 12. It will be appreciated that other fastening means such as adhesion, mechanical devices or forms of welding may be employed in order to secure each polymer strip 14 to the pad 12. Releasable devices may be employed as well to allow the polymer strips 14 to be removed from the pad 12, thus allowing the pad to be reused thru the process of substitute polymer strips 14 being inserted into the pad 12. Likewise, the polymer strips 14 could be secured to a mount which is in turn connected, releasably, lockingly, temporarily, to the pad 12. Such configuration could provide an easy switch out feature so a polymer strip assembly could be quickly interchanged with a common pad 12.

The device 10 can be rebuilt as the tips of the strips 14 wear down. The constant grinding of the tips of each strip 14 allows fresh diamond particles to be exposed which in turn provide a renewed cutting surface. This unique feature reduces heat on the strips 14. It also minimizes build up or clogging of the cutting surface on each strip so as to increase performance. Traditional cutting or finishing tools clog up their cutting surface because, inter alia, they have too much exposed cutting surface. The present inventions overcome this problem by exposing the tip of the cutting member which is designed to have it corresponding abrasive cutting surface approach the work surface at a predetermined angle and wear down so as to continuously expose a fresh abrasive cutting surface or surfaces.

Figure 5B:
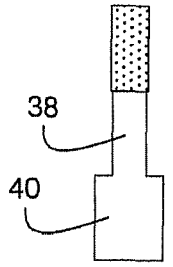
FIG. 5B is an end view of an alternative polymer strip.

With continued reference to FIG. 2, the plurality of slots 16 extending around the periphery of the pad 12 can have a variety of geometric configurations so as to aid in the retention of the polymer strip 14 relative to the pad 12. A preferred method to join the polymer strip 14 to the pad 12 is to slide the polymer strip 14 within the slot 16 thus causing an interference fit there between. However, it will be appreciated that alternative profiles such as FIGS. 5B and 5C can be contemplated where a T-shaped slot 36 can be machined or otherwise generated within the pad 12. A corresponding T-shaped alternative polymer strip 38 having a lower portion 40 is received with said slot 36. Such configuration would provide an enhanced frictional engagement between the polymer strip 38 and the pad 12 so as to minimize dislodgement of the polymer strip 38.

Figure 5C:
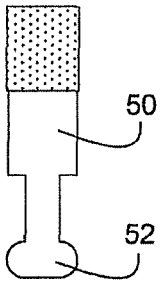
FIG. 5C is an end view of another alternative polymer strip.

As another example the pad 12 could have a slot 16 with profile of an arcuate shaped slot 42, a rounded slot 43, a dove tailed slot 44, a straight thinned slot 46, or a modified T-shaped slot 48, as are shown in the alternative profiles in FIG. 2. It will be appreciated that an assortment of geometric configurations could be employed so as to enhance connectability of the polymer strip 14 relative to pad 12. FIG. 5C illustrates an alternative strip 50 having an arcuate shaped lower area 52 that is operable to be received within slot 42 that is shown in FIG. 2.

Figure 6:
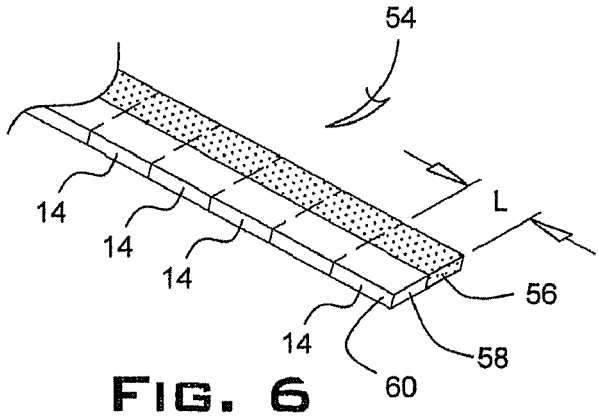
FIG. 6 is a schematic view of a continuously extruded piece of polymer strip prior to being cut in its useable length.

Each polymer strip 14 is preferably made of a nylon and is co-extruded or molded so as to include an abrasive material, such as diamonds, that defines a cutting surface or tip 22. The polymer strips 14 can be manufactured individually, or, derived from an extruded or molded sheet of nylon stock 54 as seen in FIG. 6 wherein a plurality of individual polymer strips 14 can be cut from the stock 54 so as to be produced in mass quantities. Each polymer strip 14 has an abrasive section 56, a middle section 58 and an attachment section 60 which is the portion that is slid into and received within the corresponding slot 16. The abrasive section 56 preferably may include 5%-40% abrasive material 64 with the remainder of its constituency being nylon. The abrasive material 64 can be diamonds or the like. The diamonds may be equally distributed throughout the abrasive section 56 both on its exterior surface and throughout its interior. Alternatively, the abrasive material 64 may be embedded on the exterior surface only. The middle section 58 and the attachment sections preferably are made of nylon 62 or other resin.

Alternative abrasive material can be formed on, formed in, or otherwise part of the abrasive section 56, such as aluminum oxide. Aluminum oxide could be used as a filler material with the nylon material to form the abrasive portion or surface which in turn engages the surface to be finished. Other abrasive materials may be used to fill the nylon to form a polymer strip 14 that can polish a variety of floors, such as a wood floor. It will be appreciated that materials other than nylon may be employed in conjunction with aluminum oxide so as to form a novel polymer strip as long as it performs under the conditions stated herein.

During operation, the tip 22 engages the concrete surface 24 and begins to wear away during use thus continuously exposing fresh diamond particle edges 66 to the concrete surface 24. As the nylon material in the area approximate to the diamond particle edges 66 begins to erode, the diamond particle edges 66 may dislodge from the nylon thus exposing fresh diamond particles 66. This process repeats throughout the cleaning and polishing process. The tip 22 wears evenly along its length L thus providing a smooth engagement surface for interfacing with the concrete surface 24. The nylon material that is dispersed between the diamond particles 66 aids in cleaning the concrete while the diamond particle edges 66 provide the abrasive material to accomplish the concrete floor polishing function. Thus, a combined cleaning and polishing action is simultaneously obtained by the use of this novel apparatus.

The grit size of the diamond particles 64 vary based upon the desired performance of the device 10. For example, the present invention contemplates providing an enhanced floor sheen through normal cleaning applications whereby each time period, for example a week will be discussed, a different grit size is utilized on the polymer strips 14. For example, in a multi-week cleaning/polishing program, week one could contemplate utilizing a device 10 having polymer strips 14 with abrasive material embedded therein having a grit size of 50 to 60. The process would continue wherein a grit size of 100 could be utilized in week two. A grit size of 200 could be utilized in week three. A grit size of 400 could be utilized in week four. A grit size of 1000 could be utilized in week five. A grit size of 2000 could be utilized in week six, and so on. Thus, it is contemplated that the present invention may include a process for improving the sheen of concrete through and during the normal cleaning process whereby different abrasive material members are employed each successive week until a desired finish has been obtained. The higher the grit size the finer the diamond or abrasive particles being used, thus resulting in a higher sheen. Thus, it is contemplated to utilize one aspect of the present invention where one has a rough or hard-to-sweep surface which is then honed, made smoother, and the gloss is improved.

One process of manufacturing the polymer strip 14 having the abrasive particles 64 embedded therein includes utilizing a heat process that alone melds the diamond particles with the polymer. No bonding agent is required for this method of manufacture. The abrasive particles 64, such as the diamond particles, can be co-extruded with the nylon for high heat, high strength or nicola for softness and flexibility of the polymer strip 14. It will be appreciated that alternative materials can be used besides nylon so long as it withstands, inter alia, the operating conditions of approximately 125 to 200 rpm's and approximately 150 to 200 lbs. of total pad pressure. Other materials have been found to degrade during these conditions and thus will not suffice as a substitute for the present application. However, a base material, such as nylon, can be used that has the flexibility that is required so long as it allows the tip 22 to properly flex upon engagement with the concrete surface 24. It will be appreciated that the thickness, length, width, and geometry of the strip 14 can be modified so as to perform in a variety of conditions.

Figure 7:
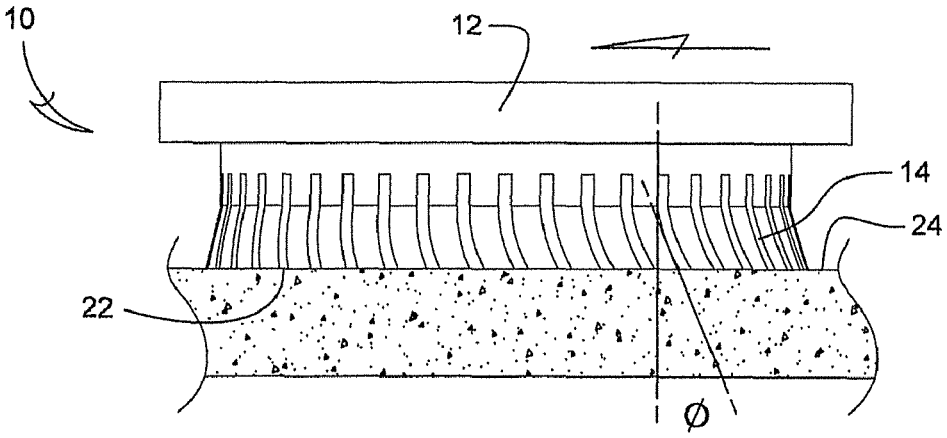
FIG. 7 is a side view of a brush assembly and its polymer strips engaging the concrete's surface.

For example, as seen in FIG. 7, the polymer strip 14 is pliable against the concrete surface 24 and flexes relative to the pressure applied by the pad 12 and the flooring machine (not shown) located above the pad 12. The angle of deflection Ø of the strip 14 relative to a line perpendicular to the surface of the concrete surface 24 is preferably between 5 to 45 degrees. The angle of deflection Ø is important to the efficient operation of the device 10. It is preferred to have a constant angle of deflection Ø which is unlike prior floor finishing systems. If the strip 14 operates with too much deflection, then the strip 14 will not wear uniformly. By contrast, if the strip 14 does not have enough angle of deflection Ø during operation, then chattering may occur or a balling condition may develop. Chattering creates a high pitched irritable sound and is unpleasant to the operator of the machine and those around him. It is preferred to have a level of deflection of the strip 14 such that each strip 14 wipes and cleans the concrete surface 24 as it performs its surface modifying function. The broad polymer strip 14 further functions to simultaneously sweep the surface being worked as the strip 14 abrades a work surface, such as concrete 24. Attacking the surface to be worked at a constant angle is accomplished with this invention. By contrast, conventional cleaning systems, such as hand tools that employ wires, bristles or the like, do not perform in this manner nor can they accomplish that which this invention accomplishes.

Thus, it is important to provide a polymer strip 14 with sufficient soft, flexible yet vigorous and robust material so as to operate appropriately during the aforementioned conditions and provide the appropriate angle of deflection Ø. This is accomplished by a unique formula of the stiffness of the strip 14 and the pressure applied to the pad 12 during operation of the flooring machine. The stiffness of the strip 14 is a function of its length L, width W, and height H in combination with its material composition. The pressure applied to the pad 12 is a function of the diameter of the pad 12 and the force being exerted on the pad by the flooring machine.

It will be appreciated that the present invention could be used on wood floors thus requiring a strip or brush having a metal cutting edge for removing a wood floor surface. FIGS. 26-30 illustrate examples of a brush having a metal cutting edge. Such examples have an angle of deflection Ø in the 5-45 degree range.

Figure 8:
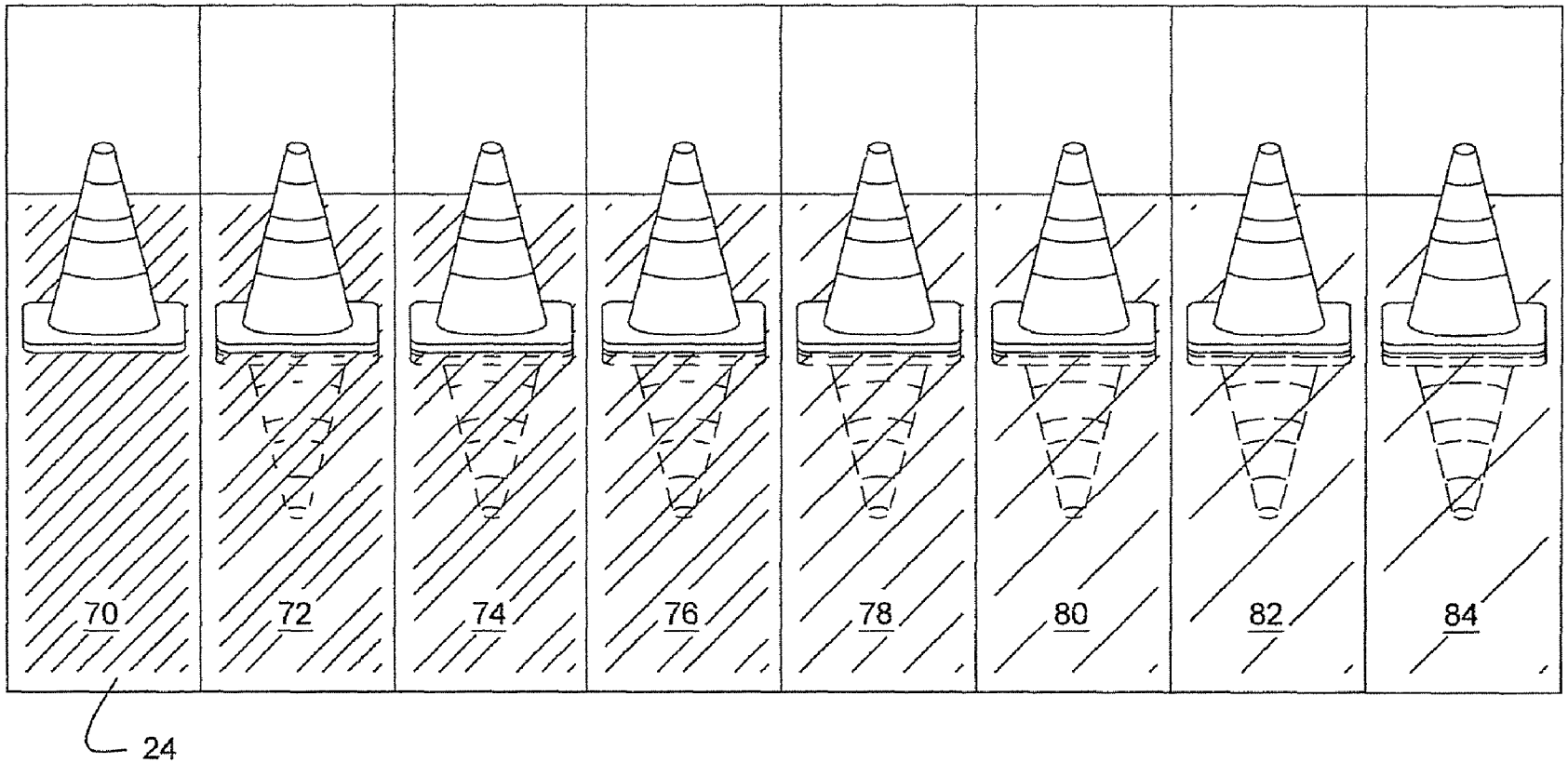
FIG. 8 is a schematic view of a series of illustrations taken in progression after the novel polishing device has been employed while using the present method of polishing a floor.

With reference to FIG. 8, an exemplary method of utilizing the present cleaning and polishing device 10 will be discussed. Each step in this method employs a strip 14 having a predetermined grit size so as to provide a certain finish. The first step of the polishing process will employ a polymer strip 14 having a grit size that is low in value such as 50 to 60. Once this appropriate grit size has been selected, and installed on the device 10, the device 10 is connected to the appropriate scrubbing machine, or the like, and the operator proceeds with the weekly cleaning of the concrete floor.

For the second step, the operator changes out the device 10 with another device 10 having a finer grit, for example a 100 series grit. Alternatively, the operator could utilize the same device 10 and existing pad 12 but change out the polymer strips 14 with individual strips having a series 100 grit. The operator then reinstalls the device 10 to the flooring machine wherein the next joint cleaning activities of the concrete floor are completed. In the following step, the operator changes out the pad 12, or the associated polymer strips 14, to a series 200 grit and reinstalls same to the flooring machine which in turn proceeds with its weekly cleaning schedule. In the depicted example, this process continues wherein each step a different grit series is utilized with the aforementioned process. With each successive step, the sheen of the floor in the warehouse or plant is increased thus enhancing the surface quality and appearance.

For example, as can be seen in FIG. 8, the picture 70 illustrates what the concrete surface 24 looked like prior to the present exemplary method of cleaning and polishing the floor was employed. As depicted, each step was carried out over a one week period. The representation 72 of week one shows an improvement in the surface appearance after the first aforementioned step was applied. The representation 74 illustrates the surface quality at week two. The representation 76 illustrates the surface quality at week three. The representation 78 illustrates the surface quality at week four. The representation 80 illustrates the surface quality at week five, and representation 82 illustrates the surface quality at week 6. As a final step a coating may be applied to the floor as can be seen in photograph 84.

Each successive cleaning step also includes its associated polishing step utilizing polymer strips 14 having finer grit sized materials. The present method, once completed, requires no additional steps or procedures in order to achieve a finished floor. Thus, through use of the novel device 10, and this novel method, a concrete floor can be cleaned and polished, thus eliminating the manpower, machinery and costs that are associated with traditional floor polishing methods.

Figure 9:
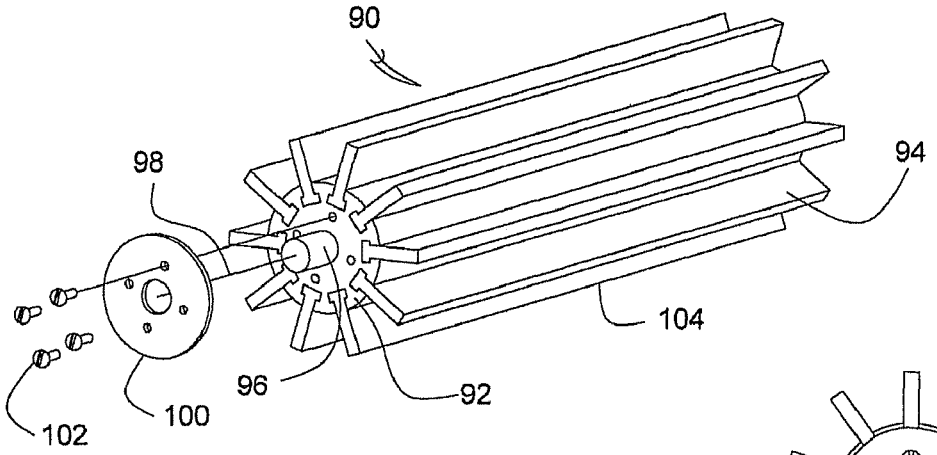
FIG. 9 is a perspective view of an alternative brush assembly.
Figure 10:
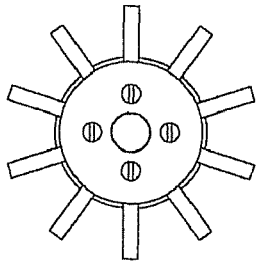
FIG. 10 is an end view of the brush assembly that is shown in FIG. 9.

As shown in FIG. 9, a rotating paddle-like brush assembly 90 has a cylinder 92 with a plurality of elongated strips 94 embedded or secured to the cylinder 92. An axle 96 has central axis 98 and a cover 100 is held in place by fasteners 102 so as to retain the strips 94 in place. A similar cover 100 and fasteners 102 are located on the distal side of the cylinder 92 but are not shown. Each strip 94 has an abrasive section and an attachment section as is shown in the strips illustrated in FIGS. 5A, 5B and 5C. The assembly 90 rotates about a horizontal axle 96 and can be used with a horizontal axis flooring machine. FIG. 10 illustrates an end view of the FIG. 9 device. The flooring machine imparts motion to the axle 96 and allows the tips 104 of the brush 94 to engage and work a floor surface.

An alternative method of polishing a floor surface is disclosed wherein the first step includes using a device with the flooring machine that employs abrasive members and a pad as is disclosed in U.S. Ser. No. 11/655,742 entitled "ABRASIVE PREPARATION DEVICE WITH AN IMPROVED ABRASION ELEMENT ASSEMBLY," owned by the present applicant, which is hereby incorporated by reference. The method employs the abrasive preparation device as is disclosed therein while utilizing the steps set forth and shown in the steps 70-84 in FIG. 8 and its discussion thereof.

Figure 11:
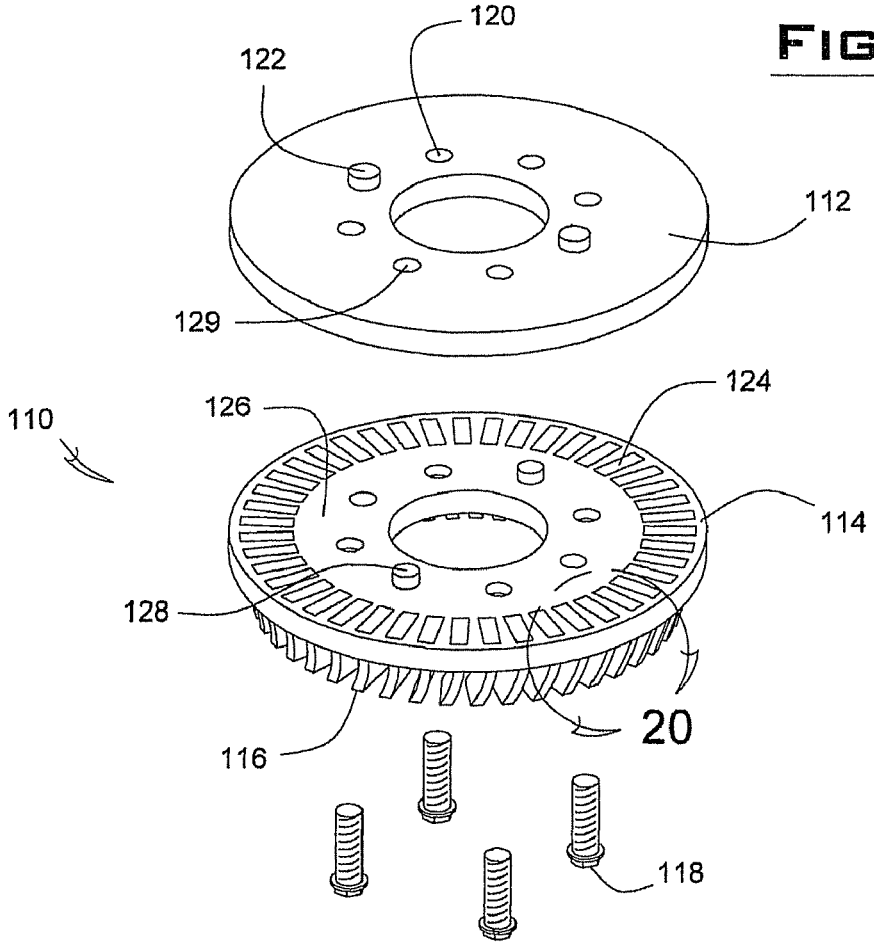
FIG. 11 is an exploded view of an alternative brush assembly that utilizes a one-piece insert.

With reference to FIG. 11, an alternative floor finishing brush assembly 110 includes a retainer 112, a driver pad 114, abrasive brushes 116 and fasteners 118 for securing the driver pad 114 and retainer 112 together. The retainer 112 includes clearance holes 120 and it is circular-shaped so as to match the profile of the driver pad 114. Protrusions 122 are operable to engage recesses within a hub assembly of the floor polishing machine, not shown.

The driver pad 114 has a plurality of spaced apart slots 124 that are operable to receive the individual brushes 116. Each brush 116 can drop down through the top surface 126 and are sandwiched by the retainer 112 so as to hold the brushes 116 in place. The fasteners 118 extend through holes 120 in the retainer 112 so as to secure the retainer 112 relative to the driver pad 114. When the brush assembly 110 is assembled, the brushes 116 are firmly held in place relative to the driver pad 114, however, their distal ends are operable to freely flex depending upon operating conditions. It will be appreciated that the brushes 116 can be of the configuration of the types of strips 14 that are shown in FIGS. 1-5C. Also, the retainer 112 and the driver pad 114 are preferably made of plastic material. The driver pad 114 has alignment members 128 that mate with corresponding holes 129 in the retainer 112.

The brush assembly 110 is operable to be used with a standard floor scrubbing machine with a pad pressure of approximately 150 to 200 pounds and at RPMs in the range of 125 to 200. It will be appreciated that the brushes 116 can be changed out and replaced with new brushes. For example, the assembly 110 can be loaded with brushes 116 having a rough grit size while later being changed out to have brushes 116 having a finer grit size.

Figure 12:
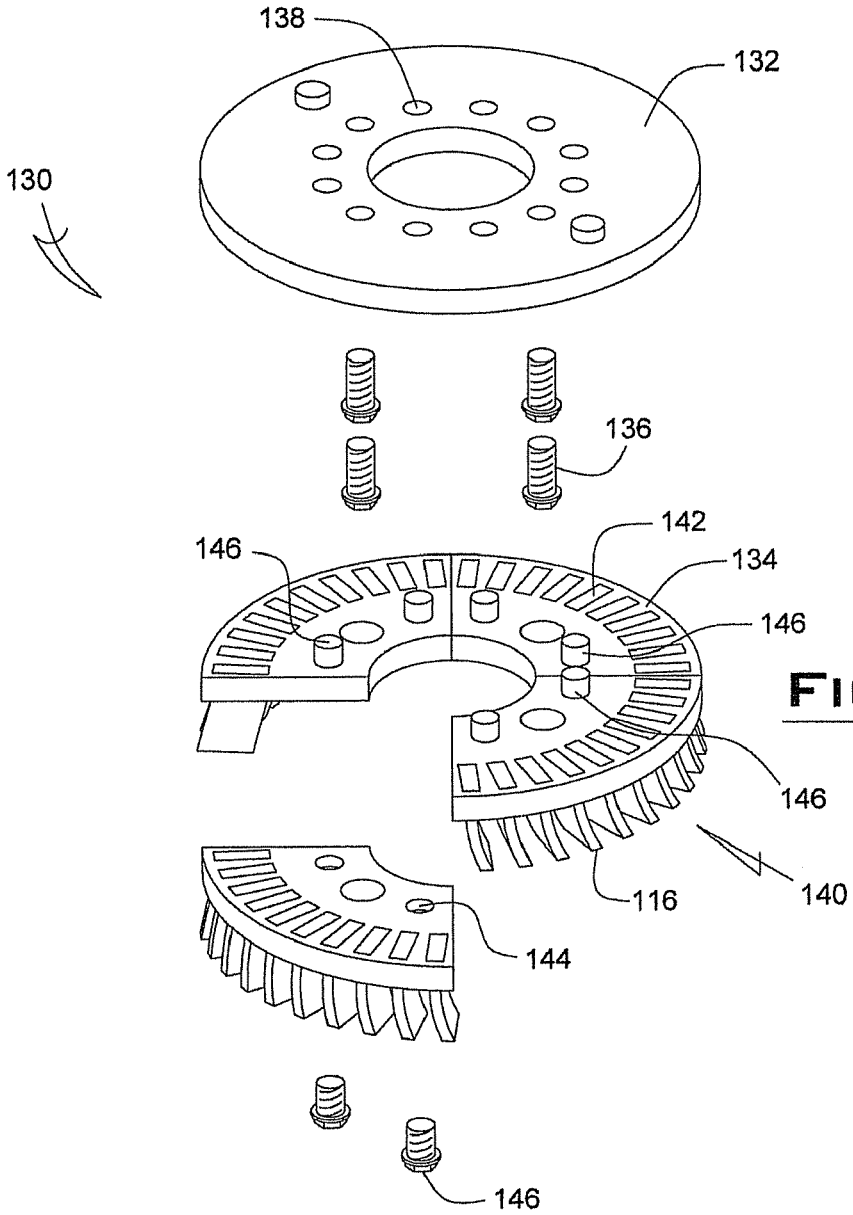
FIG. 12 is an exploded view of another alternative brush assembly that utilizes a four-piece insert.

FIG. 12 illustrates an exploded sectional view of yet another alternative brush assembly 130 having a retainer plate 132, a sectional driver pad 134 and fasteners 136 for securing the assembly 130 to the floor finishing machine. The retainer plate 132 has a plurality of holes 138 for receiving fasteners 146 which secure the retainer plate 132 and the driver pads 134 together.

The driver pad 134 is a quarter section and four driver pads 134 are aligned so as to collectively define a circular-shaped driver pad assembly 140. Each driver pad 134 has slots 142 that are operable to receive brushes 116. The driver pad 134 further has clearance holes 144 that are operable to receive fasteners 146. By providing sectional driver pads 134 as shown in FIG. 12, the user can easily switch out sections of the drive pad assembly 140 to have brushes 116 with different abrasive characteristics. For example, one section could have a grit series of 100, while another quarter section could have a grit series 200, if desired. The brush assembly 130 provides an operator with the opportunity to employ a device with brushes 116 having different grit sizes.

The fasteners 146 extend up through a top surface of the drive pad 134 which in turn engage threaded holes 138 in the retainer plate 132. It will be appreciated that other fastener means may be employed so as to secure the retainer plate 132 and the driver assembly 140.

Figure 13:
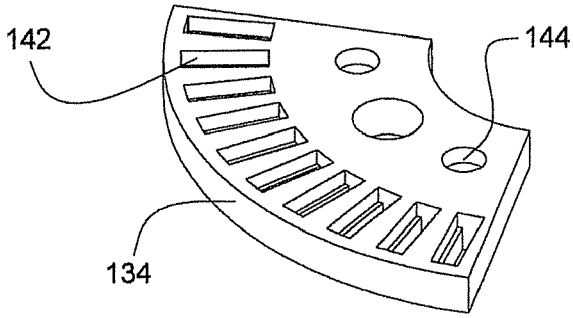
FIG. 13 is a perspective view of one of the sections of the insert.

FIG. 13 illustrates the driver pad 134 as shown in FIG. 12. The slots 142 are shown in greater detail wherein illustrated is a stepped-configuration within each slot for securing each brush 116 in place. Each slot 142 has a t-shaped configuration which allows a brush, for example the one illustrated specifically in FIG. 5B, can be inserted therein.

Figure 14:
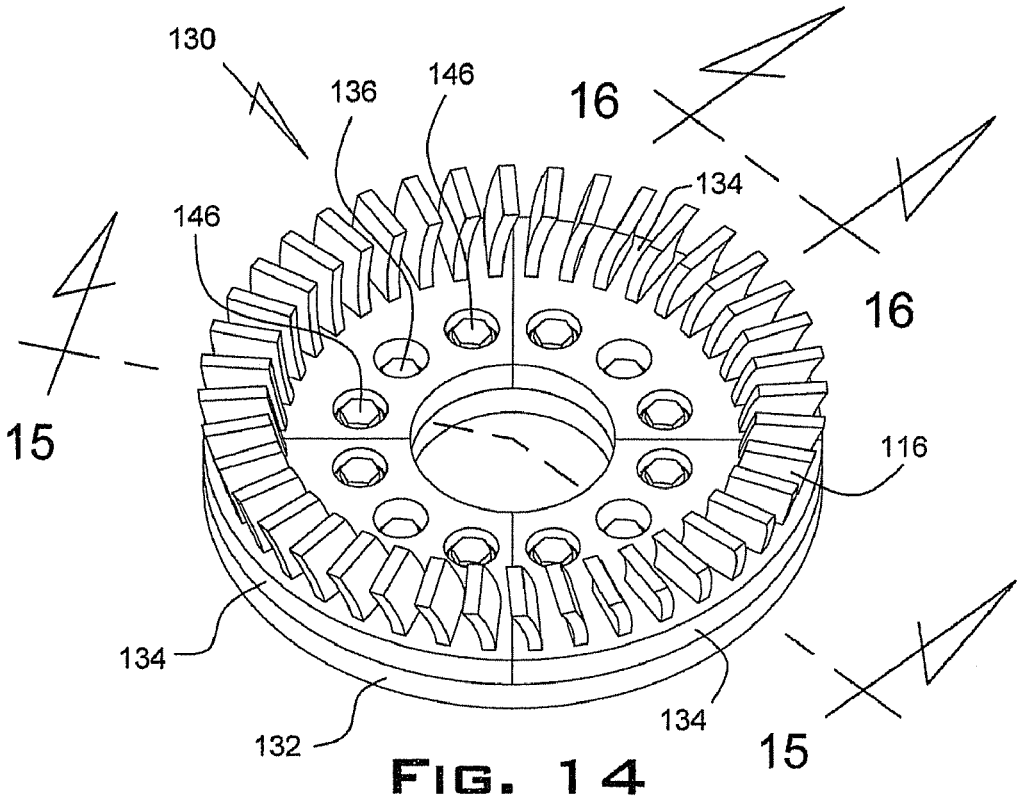
FIG. 14 is an underside perspective view of the FIG. 12 device, but shown assembled.

FIG. 14 illustrates the FIG. 12 assembly 130 fully assembled, but viewing it from the bottom perspective view. The retainer plate 132 has been secured to each of the four driver pads 134. The brushes 116 are held firmly in place and the assembly is ready for being secured to a floor finishing machine. Fasteners 136 connect the assembly 132 to the floor finishing machine (not shown).

Figure 15:
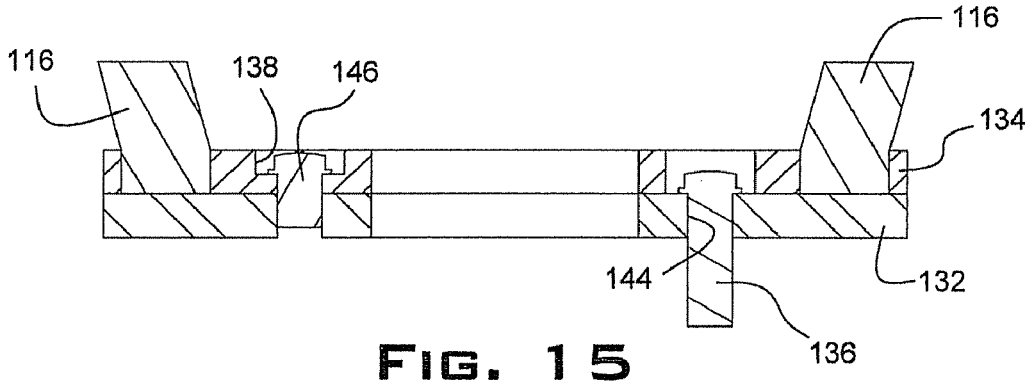
FIG. 15 is a section view taken from lines 15-15 of the FIG. 14 device.

FIG. 15 is a side sectional view taken along lines 15-15 of FIG. 14. The brush 116 is shown compressed between the retainer 132 and the driver pad 134. The fasteners 146 are received within holes 138 and are threaded to a bore within the driver pad 134. Fastener 136 is shown passing through a hole 144 within the retainer plate 134 and in turn is secured to the undersigned to a floor finishing machine, not shown. The retainer plate 132 and the driver pads 134 are preferably made of high strength durable plastic material.

Figure 16:
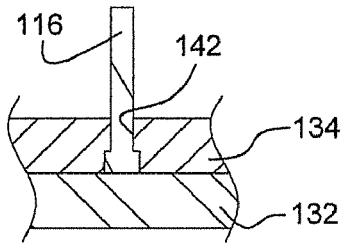
FIG. 16 is a section view taken from lines 16-16 of the FIG. 14 device.

FIG. 16 illustrates a partial sectional view taken from lines 16-16, of FIG. 14. A brush 116 is shown located within a slot 142 that is within the driver pad 134. The retainer plate 132 holds the brush 116 within the slot 142.

Figure 17:
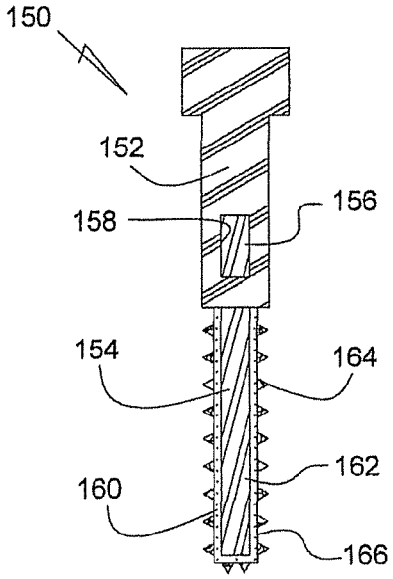
FIG. 17 is a side view of a polymer strip having a metal insert.

FIG. 17 illustrates an alternative brush construction that may be utilized with the assemblies disclosed herein. This style of brush can be used to prepare concrete surfaces that later need to have a coating applied. It will be appreciated that other brush configurations could be utilized besides those that are disclosed herein. The brush 150 includes a two piece construction having an upper nylon portion 152 and a metal portion 154. The nylon portion 152 is t-shaped and is operable to fit within the slot configuration that is shown in the FIG. 12 assembly 130. The metal portion 154 has been manufactured by an over molding process whereby the nylon portion 152 surrounds part of the metal thus creating the brush 150 having a rigid portion and a flexible portion. The metal portion 154 can be made of a banding strip or other metal that wears and allows particles 164 to abrade off and expose new diamond or abrasive particles as the brush 150 wears down.

An upper segment 156 of the metal portion 154 extends through a window 158 of the nylon portion 152 which helps to lock the two portions together. The metal portion 154 has a coating 160 that has first been applied to a metal strip 162 prior to the over-molding process. The coating 160 can be a mixed brazed material with a blend of nicrobraze and binder material. A sufficient thickness, such as 10 mm, of the coat 160 should be used so as to bind abrasive particles 164 to the outer surface of the metal strip 162. The preferred abrasive particles 164 includes diamond particles which can be blown onto the coating 160 while in its liquid state. It is preferred that the abrasive particles 164 are consistently dispersed about the outer surface 166 of the metal strip 162. It will be appreciate that a plating process could be used where the metal portion 154 is plated with nickel and abrasive particles 164 are then introduced to create the cutting surface.

Figure 18:
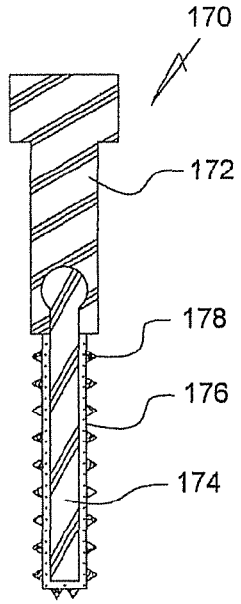
FIG. 18 is a side view of an alternative polymer strip having a metal insert.

With reference to FIG. 18, an alternative brush assembly 170 has a first nylon portion 172 and second nylon portion 174 that are affixed to one another. This style of brush assembly can be used on many surfaces and applications such as removal of wood, removal of wax, to polish concrete, and to clean and hone concrete. The nylon portion 172 is t-shaped, but it will be appreciated that other configurations may be employed. The brush assembly 170 is a two-piece brush with different flexible characteristics. For example, the nylon portion 172 may be stiffer and more rigid while the nylon portion 174 may have greater flexibility which provides a brush assembly that can have a variety of flexible characteristics.

The nylon portion 174 can be over-molded to the nylon portion 172, and could be mechanically fixed to one another, or could be coextruded in order to form an integral brush assembly 170. The nylon portion 174 has a coating 176 similar to that discussed herein with abrasive particles 178 around its exterior. The abrasive particles could include diamond particles. The abrasive particles 178 are operable to dislodge from the nylon portion 174 and allow new abrasive particles 178 to be exposed as the brush deteriorates.

Figure 19:
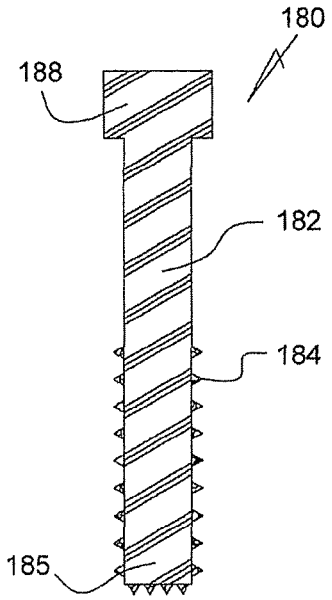
FIG. 19 is a side view of an alternative one-piece polymer strip.

With reference to FIG. 19, an alternative brush assembly 180 includes a one-piece nylon brush 182 with abrasive particles 184 positioned on its lower portion 185. The particles 184 can be impregnated throughout the lower portion 185. The brush 182 is t-shaped and has an upper end 188, however, it will be appreciated that other geometric configurations could be utilized. The one-piece brush 182 provides consistent flexibility throughout its construction. The brush assemblies 150, 170 and 180 can be employed with the various driver pads which have been disclosed herein.

Figure 20:
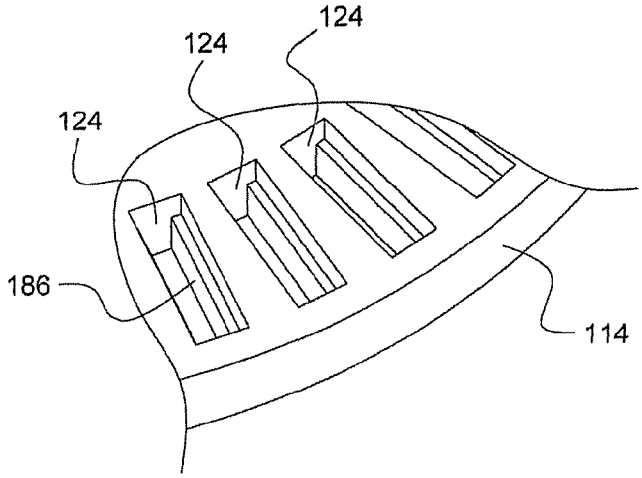
FIG. 20 is a partial section view illustration the slots of the driver pad.

FIG. 20 illustrates an enlarged partial view of the driver pad 114 that is illustrated in FIG. 11. The driver pad 114 has a plurality of slots 124 that extend through the driver pad. Each slot is operable to receive its own brush, for example, the brushes 150, 170 or 180.

Each slot 124 has a staggered configuration that includes an offset wall 186 that acts as a stop for retaining the upper end 188 of a brush in place. For example, see FIG. 19, brush assembly 180, where the upper end 188 is t-shaped which allows it to be received within slot 124 as depicted in FIG. 20. It will be appreciated that the slots 124 could be configured differently in order to accommodate an upper end 188 that has a different geometric configuration. A stop mechanism within the slot 124 helps to prevent the brush 180 from passing through the driver pad 114. Alternatively, a different means for securing a brush 180 relative to the driver pad 114, could be employed.

Figure 21:
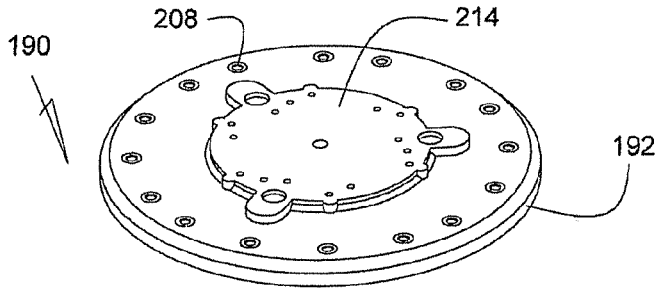
FIG. 21 is an exploded view of an alternative brush assembly that utilizes a four-piece insert in connection with a driver pad.

With reference to FIG. 21, an alternative driver assembly 190 includes four separate driver sections that are collectively arranged so as to form a circular shaped driver pad that in turn is connected to a retainer. The driver assembly 190 includes a retainer 192, driver pad sections 194, 196, 198, 200, fasteners 202, and a plurality of brushes such as brush 180. Each driver pad section 194, 196, 198 and 200 is identical in construction and fasteners 202 extend up through holes 212 within each driver pad and are in turn threaded to stubs 208. Each driver pad section 194 has a plurality of slots 210 extending therethrough that are operable to receive their own brush, for example brush 150, 170 or 180. The driver pad sections 194 are made of a rigid plastic and each of the four sections are aligned adjacent to each other so as to form a complete circle. The retainer 192 is preferably made of plastic and is operable to mate with the driver pad sections so as to form a complete assembly. The retainer 192 has a raised surface 214 that operates as the mounting surface for attaching to a floor finishing machine.

Figure 22:
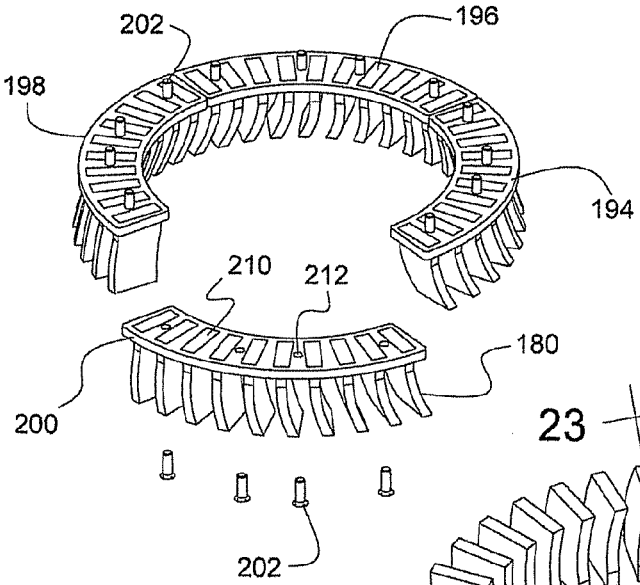
FIG. 22 is an underside view of the assembled FIG. 21 device.

FIG. 22 illustrates a bottom view of the FIG. 21 driver assembly 190, but the retainer 192 is fastened to the four driver sections to form a rigid brush assembly having a plurality of flexible brushes.

Figure 23:
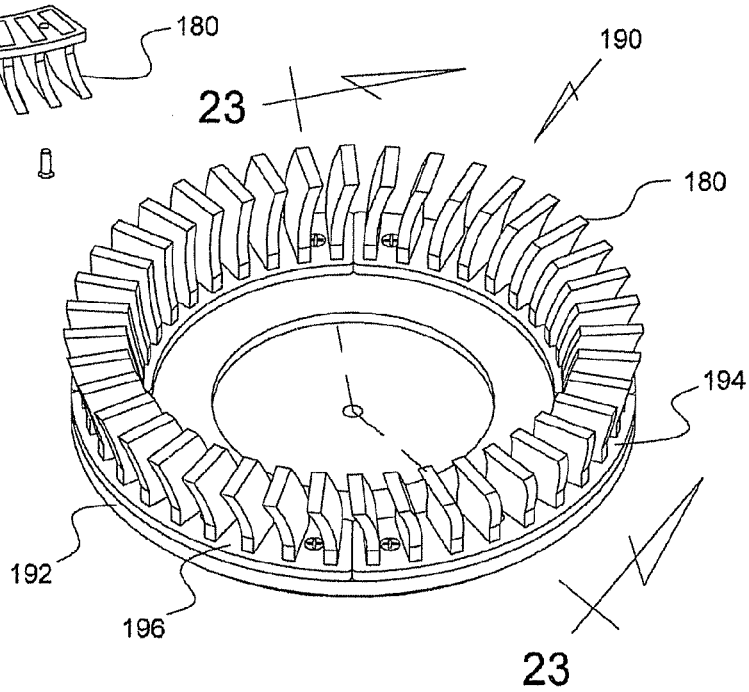
FIG. 23 is a section view taken from line 23-23 of FIG. 22.
Figure 23:
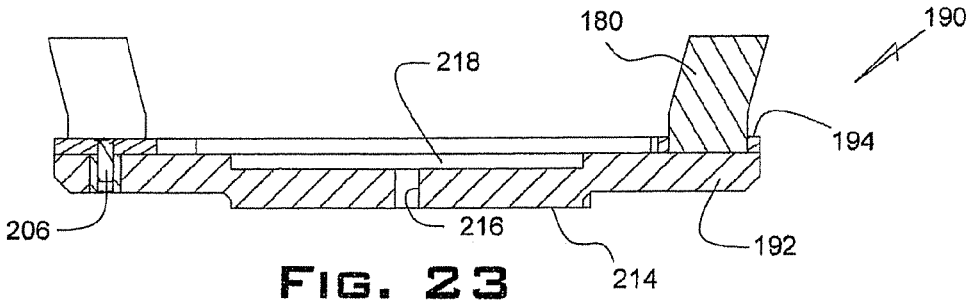

FIG. 23 is a side sectional view taken from the perspective of lines 23-23 of FIG. 22, showing the driver assembly 190. The retainer 192 has a passage way 216 that can act a pilot hole for aligning the brush assembly 190 relative to the hub of the floor finishing machine (not shown). The retainer 192 has a recess 218 on its underside. It will be appreciated that an operator can easily remove one of the driver pad sections 194 from the assembly 190, and replace same with a new section having different brush 180 grit sizes. For example, if one section is damaged, a new section can be quickly interchanged by the operator. Likewise, by providing a sectional driver pad assembly as disclosed, the operator while in the field can easily change out the individual brushes 180 and replace them with different brushes having different grit characteristics. Thus, the assembly 190 is flexible in that it allows an operator to easily change, while in the field, the abrasive material for a particular job. Likewise, a common retainer 192 can be used with the various sections, thus, reducing the cost by providing a common component that can be used with a number of other driver sections that may have different brushes 180 of different grit sizes.

Figure 24:
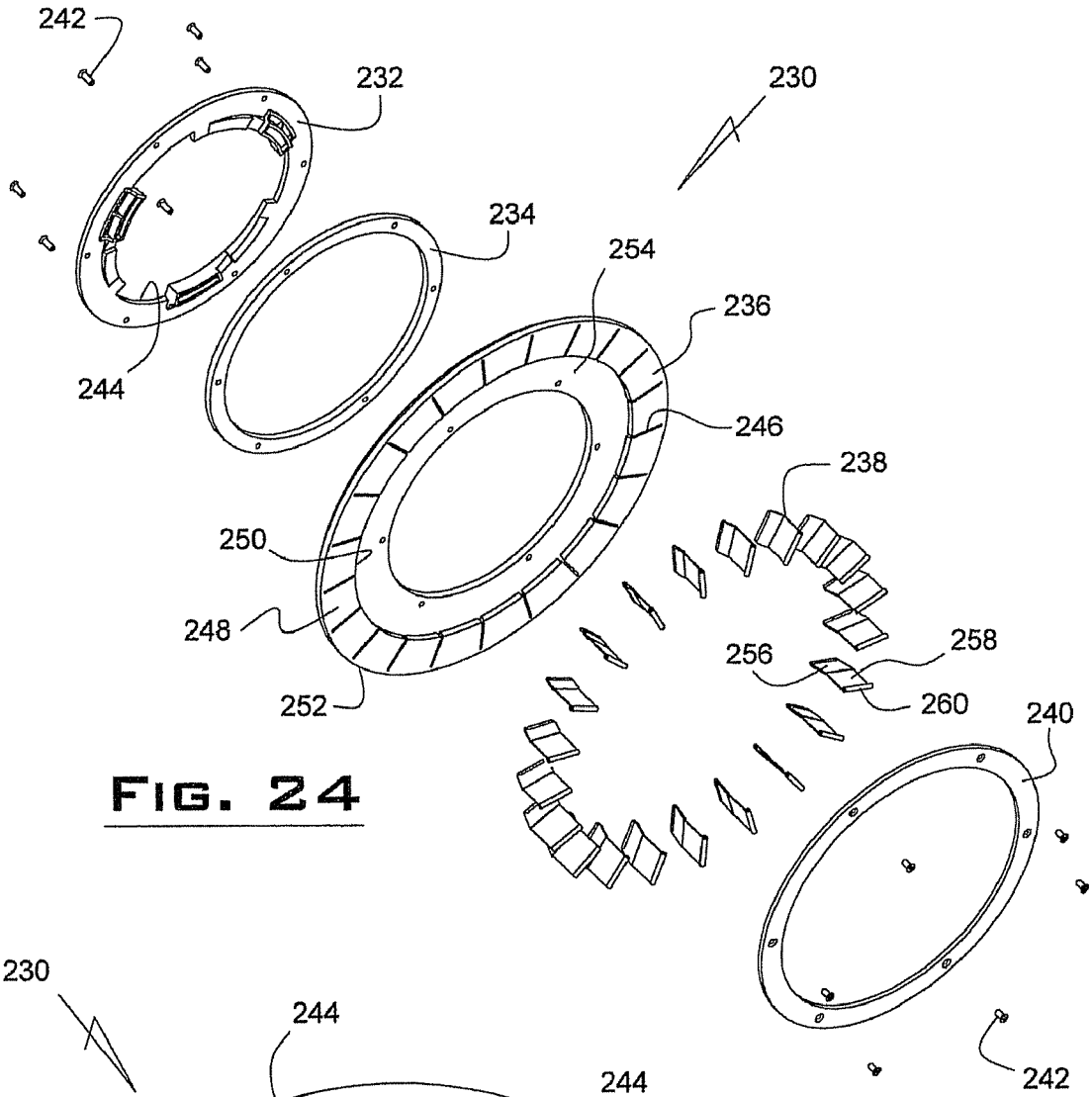
FIG. 24 is an exploded view of an alternative brush assembly wherein curved brush strips are used.

FIG. 24 illustrates an alternative driver assembly 230 having a plurality of brushes that slide within slots within a driver and are in turn held in place by a retainer. The driver assembly 230 includes a hub 232, a spacer 234, a driver pad 236, a plurality of brushes 238, a retainer 240 and fasteners 242. The assembly 230 is preferably made of high strength plastic. The hub 232 is ring-shaped and has slots 244 that are operable to engage fingers that extend from the floor polishing machine (not shown). The spacer 234 is sandwiched between the hub 232 and the driver pad 236 and is held in place by fasteners 242.

The driver pad 236 has a plurality of radially extending slots 246 that are operable to receive one end of the brush 238. The slot 246 can be either formed within or machined within the radial lip 248 that extends around the perimeter of the driver pad 236. The slots 246 extend from an inner surface 250 and extend outwardly towards the outside diameter 252 of the driver pad 236. However, the slots 246 do not extend all the way out to the outside diameter 252 so as to provide a stop for one edge of the brush 238 to meet against. Slots 246 can be configured to have a t-shape, for example as illustrated with brush 180 in FIG. 19, or to have one of the geometric configurations so as to be used with the brushes shown in FIG. 2. Once the driver pad 236 is loaded with all of the brushes 238, the retainer 240 is seated against under surface 254 of the driver pad 236. The fasteners 242 are then threaded through the retainer 240 and then secured to the under surface 254.

The brushes 238 can be of the type illustrated in the Figures and the specification herein. Alternatively, the brushes 238 can be manufactured to have a mounting portion 256 and downwardly extending portion 258 with a lower portion that has a tube shaped or curved portion 260 with an abrasive material thereon for engaging a work surface, for example, of concrete.

Figure 25:
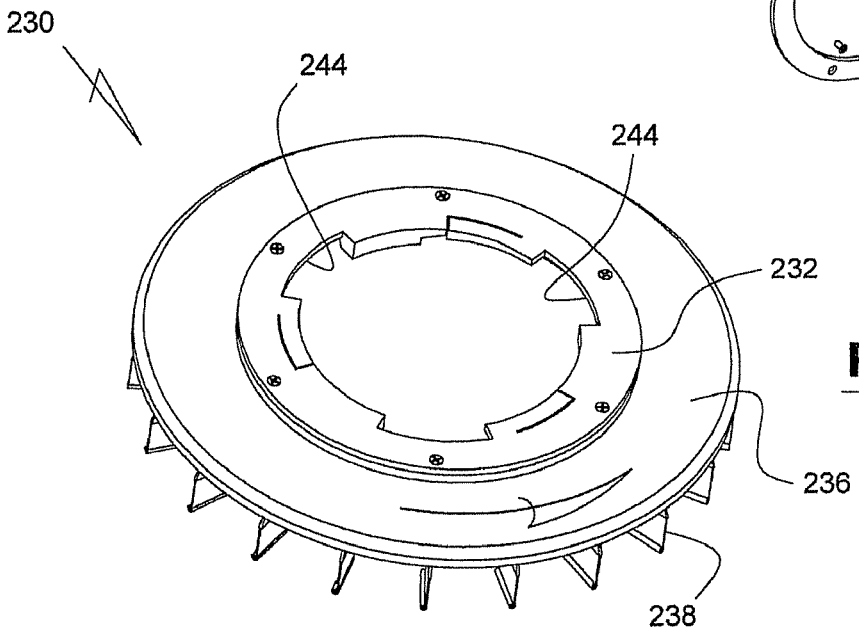
FIG. 25 is the assembled FIG. 24 device.

FIG. 25 illustrates an isometric view of the brush assembly 230, however, in an assembled condition. The hub 232 is shown fastened to the driver pad 236 and the individual brushes 238 are temporarily secured in place. The brushes depend downwardly from the underside of the driver pad 236. In the present embodiment, 21 brushes 238 are equally spaced around the perimeter of the driver pad 236 and provide multiple, flexible, abrasive contacts for working a surface.

Figure 26:
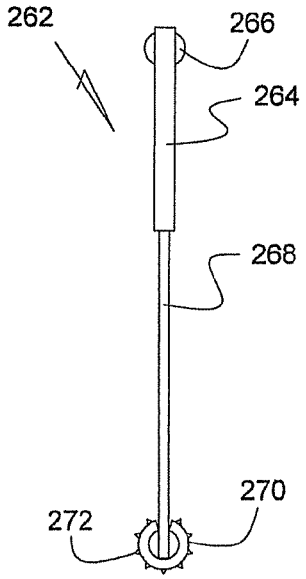
FIG. 26 is a polymer brush with a metal portion having a curved end.

FIG. 26 illustrates an alternative brush 262 having a mounting portion 264 made of nylon and a protrusion 266 that is operable to engage a similar-shaped slot within a driver pad, for example driver pad 236 shown in FIG. 24. A metal strip 268 is formed as part of or is over molded to, the mounting portion 264 thus providing a different flexibility characteristic then that of the nylon mounting portion 264. A tubular shaped member 270 is positioned over the end of the metal strip 268 so as to provide a force fit type arrangement. Abrasive material 272 has been brazed on to a substantial portion of the outer surface of the tubular shaped member 270. By providing abrasive material 272 on the tubular member 270, less abrasive material 272 is used and thus is not wasted on the metal strip 268.

Figure 27:
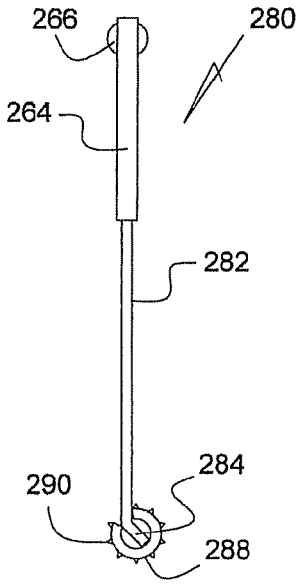
FIG. 27 is an alternative brush strip.

FIG. 27 illustrates an alternative brush 280 that includes the previously discussed upper nylon portion 264 with its associated protrusion 266. A downwardly extending metal strip 282 has been over molded, or otherwise secured to the nylon mounting portion 264. The lower end of the metal strip 282 has a bent portion 284, somewhere between 90 degrees to 180 degrees, that receives a semi-circle shaped tube portion 288 that has been brazed, or otherwise permanently secured to the bent portion 284. Abrasive particles 290 are located around the surface of the tube portion 288. The abrasive particles 290 can be applied by dipping the tube portion 288 within a bath of plating material which in turn is subjected to abrasive particles 290 through conventional means. The abrasive particles may be diamonds or other hardened particles.

Figure 28:
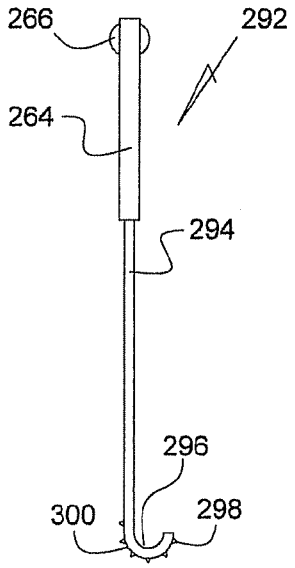
FIG. 28 is another alternative brush.

With reference to FIG. 28, an alternative brush 292 includes the nylon mounting portion 264 and the associated protrusion 266. A metal strip 294 is over molded to or otherwise fastened to the mounting portion 264. The lower end of the metal strip 294 has a j-shaped hook 296 that provides a surface for abrasive particles 298 to be located. The abrasive particles 298 may extend only along the outer surface 300 of the hook 296 which defines the abrasive surface that engages the work surface. The abrasive particles 298 may be brazed on to the outer surface 300 or a coating may be used which in turn bonds the particles 298 to the surface 300.

Figure 29:
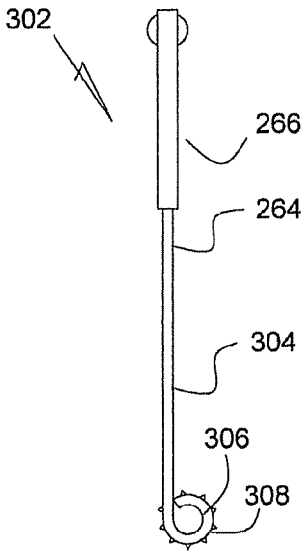
FIG. 29 is another alternative brush.

FIG. 29 illustrates an alternative brush 302 having a nylon upper mounting portion 264 and its associated protrusion 266 as previously described. A downwardly extending metal strip 304 has been over molded or otherwise secured to the mounting portion 264 and includes a tube-shaped end 306 that is formed as part of the lower tip thereof. The tube shaped end 306 provides a curved cutting surface for working a flooring surface. The outer surface of the end 306 includes abrasive particles 308, for example diamond particles that have been brazed on to said surface.

Figure 30:
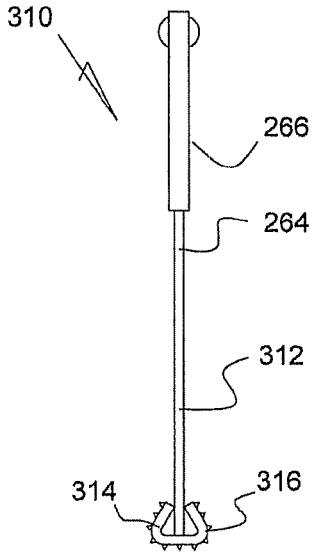
FIG. 30 is another alternative brush.

FIG. 30 illustrates an alternative brush 310 that includes the upper nylon mounting portion 264 and the protrusion 266. A downwardly extending metal strip 312 includes a straightened end that is operable to engage a triangular-shaped end member 314 that slides onto and is fixed to the tip of the metal strip 312. The end member 314 includes abrasive particles 316. The abrasive particles 316 are operable to engage a work surface and to finish it according to predetermined conditions. The brushes 262, 280, 292, 302 and 310 can be used, for example, to sand wood, remove epoxy from a surface, and to prepare a surface to be coated.

Figure 31:
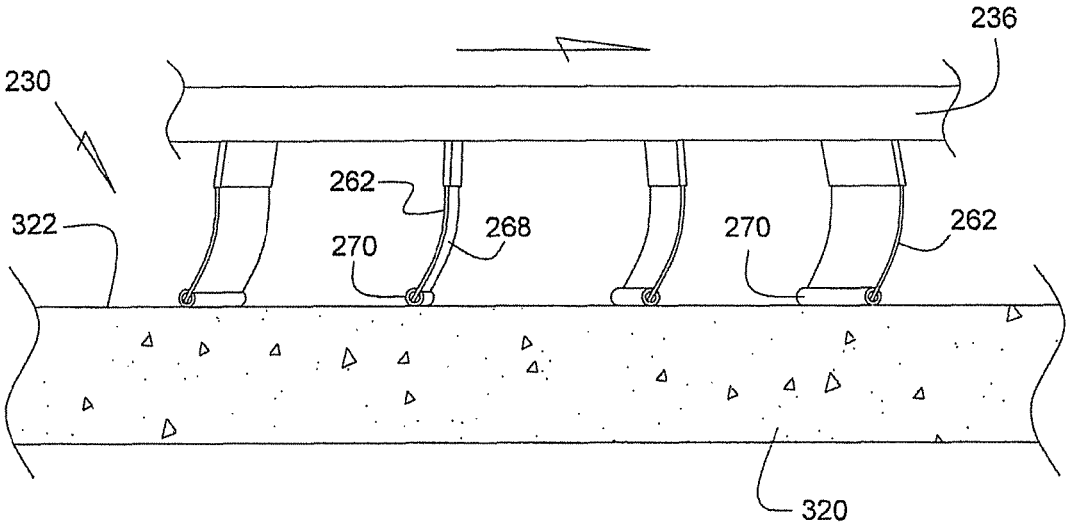
FIG. 31 is a partial side sectional view of the brush assembly engaging a concrete surface.

FIG. 31 is a side partial view of a driver assembly 230 engaging a concrete floor 322. The driver pad 236 imparts motion to brush 262 in the direction of the arrow. The brush 262 has a cutting surface defined by tubular shaped member 270 and abrasive material dispersed on the tube for working the surface 322 of the concrete 320. The tube shaped member 270 is shown deflecting while in this operating state and has an angle of deflection Ø of 5-45 degrees, as discussed in the disclosure above.

Figure 32:
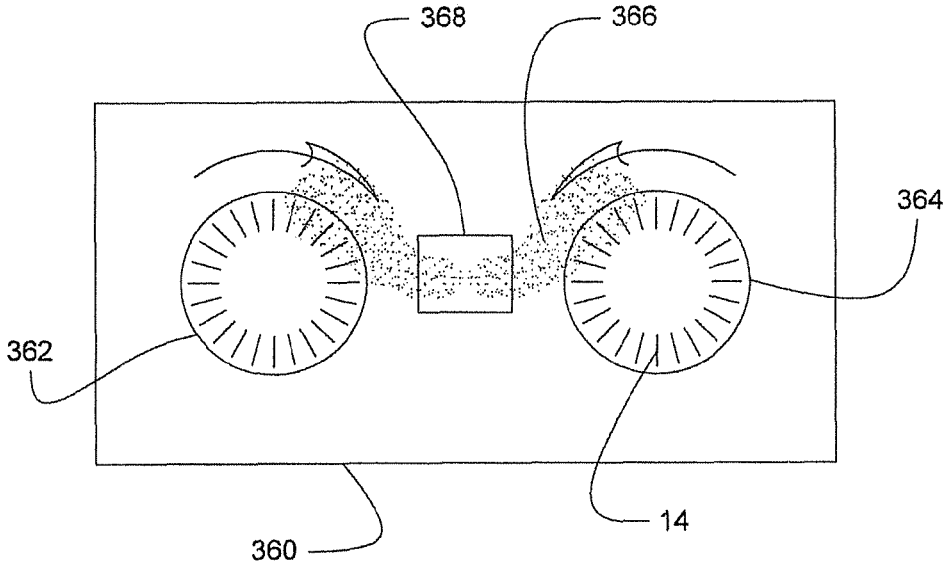
FIG. 32 is a top schematic view of a floor finishing machine including a pair of counter rotating disc pad assemblies.

FIG. 32 illustrates a top schematic view of a floor finishing machine 360 with a pair of disc pad assemblies 362 and 364 that rotate opposite one another so as to move floor particles 366 towards a vacuum collection intake 368. It will be appreciated that the pad assemblies 362 and 364 can be of the style shown in FIGS. 1, 11, 12, 22, 25, etc. For example, if the brush pad assembly 10 as shown in FIG. 1 is employed, the broad brush strips 14 operate to sweep the floor particles 366 towards the collection intake 368. Thus, when the machine 360 traverses the floor, the floor is being polished or otherwise worked while simultaneously being sweep and cleaned with the floor particles 366 being directed by the plurality of broad brush strips 14 towards the intake 38.

What is claimed is:

1. An abrasive cleaning device for modifying the surface of a floor comprising:

a rotatable housing that is operable to be connected to a cleaning machine, the housing having a plurality of slots; and a polymer strip operable to be received within each of said slots, said strip having an abrasive portion and a connection portion, wherein the abrasive portion of said polymer strip includes a metal section, a coating over the metal section and abrasive particles protruding from the coating.

2. The abrasive cleaning device as claimed in claim 1, wherein said housing includes a driver member and a retainer.

3. The abrasive cleaning device as claimed in claim 1, wherein each slot within said housing includes a stop, the connection portion of the polymer strip engages said stop.

4. The abrasive cleaning device as claimed in claim 1, wherein said housing includes a driver pad made of more than one section to form a circular shaped driver assembly.

5. The abrasive cleaning device as claimed in claim 1, wherein the abrasive portion of said polymer strip is over molded to said connection portion.

6. The abrasive cleaning device as claimed in claim 1, wherein said housing includes a hub, a spacer, a driver pad, and a retainer.

7. The abrasive cleaning device as claimed in claim 1, wherein each slot within said housing includes a shape that matches an external profile of the connection portion of the polymer strip.

8. The abrasive cleaning device as claimed in claim 1, wherein said polymer strip further includes a metal portion that is formed with the connection portion.

9. The abrasive cleaning device as claimed in claim 1, wherein the abrasive portion of the polymer strip includes a metal strip that is coated and has diamond particles dispersed on an outside surface of the coating.

10. The abrasive cleaning device as claimed in claim 1, wherein the abrasive portion includes diamond particles that wear off and new diamond particles are exposed to provide new cutting surfaces.

11. An abrasive cleaning device for modifying the surface of a floor comprising:

a rotatable housing that is operable to be connected to a cleaning machine, the housing having a plurality of slots; and a polymer strip operable to be received within each of said slots, said strip having an abrasive portion and a connection portion, wherein the abrasive portion of said polymer strip includes a tube-shaped member that is operable to engage a work surface.

12. An abrasive cleaning device for use with a flooring machine, the cleaning device comprising:

a rotatable driver pad that is operable to be connected to a flooring machine, the driver pad having a plurality of radially extending slots located within a surface of said driver pad, said slot including a first region having a first width, a second region having a second width greater than the first width, and a length greater than the first width and the second width; and a brush mountable to each slot, said brush having a mounting portion that slides within said slot, said brush further having an abrasive portion containing diamond particles that are dispersed on an exterior surface of said abrasive portion, said mounting portion including a first region having a first width, a second region having a second width greater than the first width, and a length greater than the first width and the second width, wherein the first region of the brush engages the first region of the slot, and the second region of the brush engages the second region of the slot.

13. The abrasive cleaning device as claimed in claim 12, further comprising a retainer positioned adjacent said driver pad, said retainer holds said brush in place.

14. The abrasive cleaning device as claimed in claim 12, further comprising a retainer, said retainer interlocks with said driver pad to secure said brush.

15. The abrasive cleaning device as claimed in claim 12, wherein said brush further includes a metal strip that is disposed between said mounting portion and said abrasive portion.

16. The abrasive cleaning device as claimed in claim 12, wherein said brush is made of more than one type of material.

17. An abrasive cleaning device for use with a flooring machine, the cleaning device comprising:

a rotatable driver pad that is operable to be connected to a flooring machine, the driver pad having a plurality of radially extending slots located within a surface of said driver pad; and a brush mountable to each slot, said brush having a mounting portion that slides within said slot, said brush further having an abrasive portion containing diamond particles that are dispersed on an exterior surface of said abrasive portion, wherein said driver pad is made of four separate quarter sections that are arranged to form a circle.

* * * * *